US005088630A

United States Patent [19]

Arch et al.

[11] Patent Number: 5,088,630

[45] Date of Patent: Feb. 18, 1992

[54] SEALANT CARTRIDGE WITH RESILIENT BELLOWS

[75] Inventors: Edward D. Arch, Tervuren; Heinz M. Schmitt, Waterloo, both of Belgium

[73] Assignee: Dow Corning S.A., Seneffe, Belgium

[21] Appl. No.: 588,112

[22] Filed: Oct. 22, 1990

Related U.S. Application Data

[60] Division of Ser. No. 511,889, Apr. 19, 1990, abandoned, which is a continuation of Ser. No. 269,280, Nov. 9, 1988, abandoned.

[30] Foreign Application Priority Data

Nov. 11, 1987 [GB] United Kingdom ..... 8726437

[51] Int. Cl.[5] ..... B67D 5/42

[52] U.S. Cl. ..... 222/326; 222/386

[58] Field of Search ..... 222/209, 215, 325-327, 222/386, 389, 391, 256-262, 387, 340-341; 221/58, 59

[56] References Cited

U.S. PATENT DOCUMENTS

| | | | |
|---|---|---|---|
| 2,752,074 | 6/1956 | Martin | 222/326 |
| 2,809,774 | 10/1957 | Kaye et al. | 222/263 |
| 3,250,442 | 5/1966 | Bell et al. | 222/327 |
| 3,527,389 | 9/1970 | Farmer | 222/327 |
| 4,393,982 | 7/1983 | Kuckens | 222/214 X |
| 4,522,316 | 6/1985 | Hoffmann et al. | 222/327 |
| 4,586,631 | 5/1986 | Loder | 221/58 |
| 4,601,412 | 7/1986 | Martin | 222/386 X |
| 4,640,442 | 2/1987 | Drobish | 222/386.5 X |
| 4,676,396 | 6/1987 | Mamolou | 221/36 |

*Primary Examiner*—Kevin P. Shaver

*Attorney, Agent, or Firm*—Roger H. Borrousch

[57] ABSTRACT

A cartridge intended for depositing a sealant composition with an extrusion device such as an extrusion gun is improved by exerting a constant pressure on a plunger during storage. The cartridge is a tube with an exit port on one end and a plunger on the other end where a pressure portion having a removable resilient element transmits a constant force to the composition through the plunger. The resilient element is removed before the cartridge is placed in the extrusion gun.

3 Claims, 3 Drawing Sheets

SEALANT CARTRIDGE WITH RESILIENT BELLOWS

Figure 1:
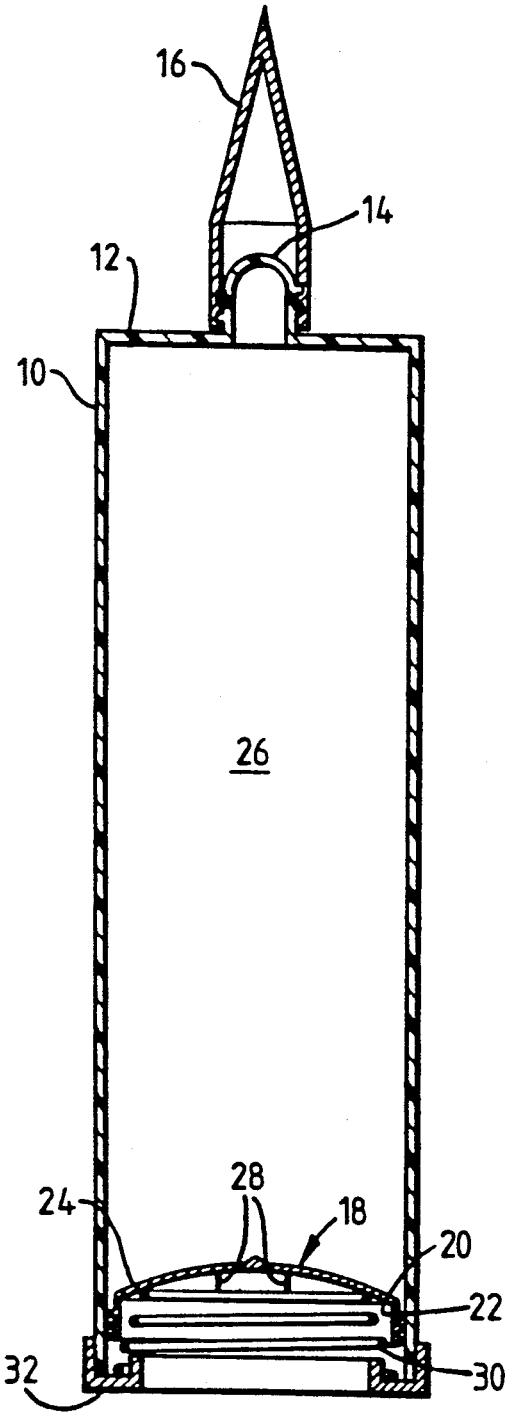
Figure 2:
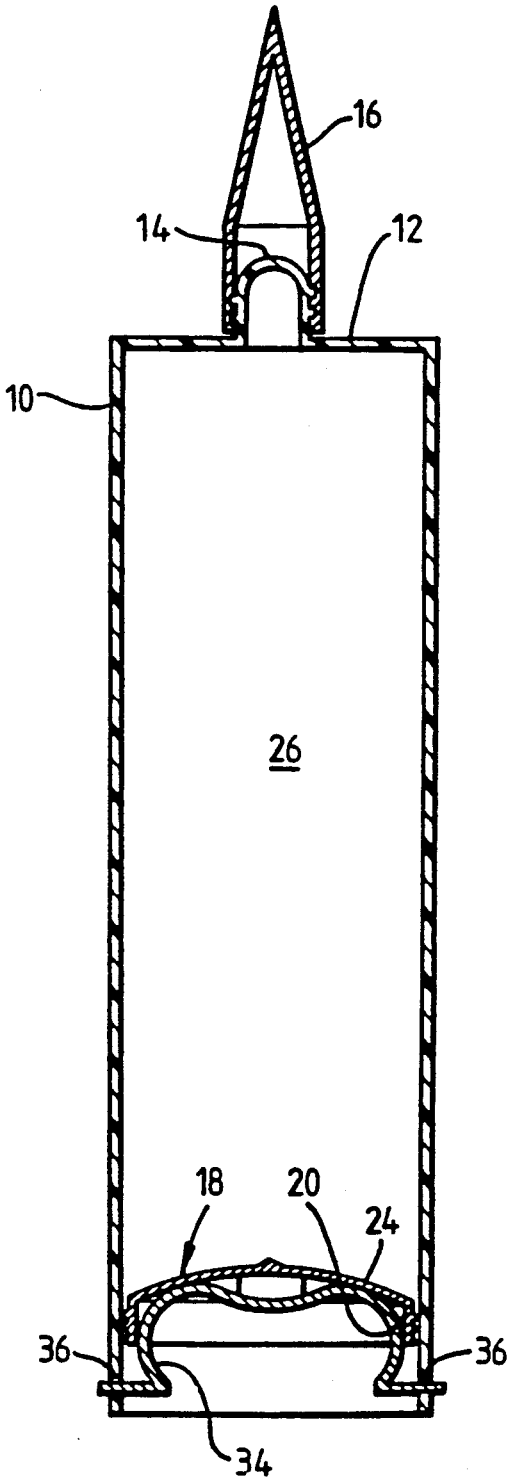
Figure 3:
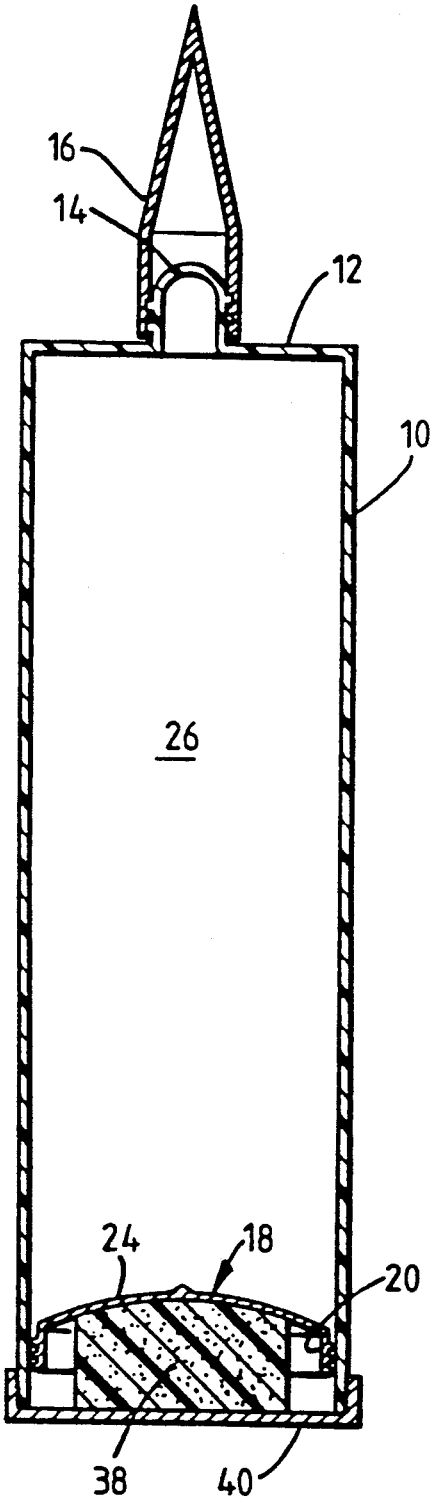
Figure 4:
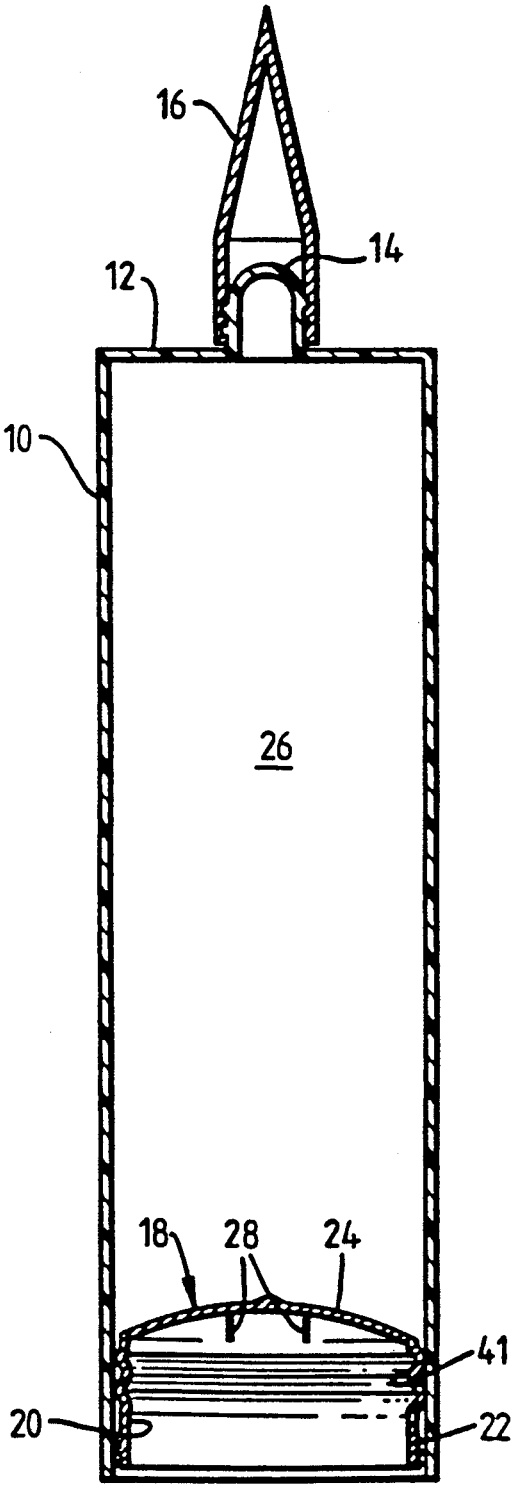

This is a divisional of U.S. Pat. application Ser. No. 511,889 filed Apr. 19, 1989, now abandoned, which is a continuation of U.S. Pat. application Ser. No. 269,289 filed Nov. 9, 1980, now abandoned.

This invention is concerned with sealant cartridges.

It is a common practice to package and supply sealant, adhesive, mastic or caulking compositions (all of which are embraced herein by the term sealant composition) in cartridges adapted to be loaded into an extrusion device in order to dispense the composition via an exit port at one end of the cartridge as a result of the application of a force from an extrusion device to a plunger located within the cartridge. Extrusion devices designed to employ such cartridges generally comprise a framework or housing in which the cartridge is supported and means for applying a force to the plunger in the cartridge. These devices generally employ trigger operated means for activation of the device and incorporate a mechanical linkage or fluid pressure operated means to apply the force to the plunger in the cartridge, for example by way of a piston. The cartridges used generally comprise a self supporting tube which may be of spirally wound fibre board, or more usually of polyethylene or aluminium. They are generally provided at one end with an exit port which may take the form of a nozzle or may be screw threaded and adapted to receive a pre-formed nozzle of desired shape, there being an impervious seal arrangement blocking the exit port which is broken, for example by cutting a portion from the tip of an integral nozzle, when sealant composition is to be extruded from the cartridge. The cartridges also contain a plunger which generally has a skirt portion in sliding contact with the interior surface of the tube and a pressure portion adapted to transmit a force to the composition to dispense the composition when desired. The plunger is generally the sole means provided for sealing the cartridge against unwanted flow of sealant composition from the rear of the cartridge and for preventing ingress of air and other materials into the sealant composition. Many proposals have been made for designs of plunger to perform these sealing functions according to which the pressure portion of the plunger may be flexible or rigid and the skirt portion may be provided with a variety of sealing arrangements. One form of plunger commonly used comprises a skirt portion having annular ribs which is a pressure fit in the tube and an integral domed portion convex towards the nozzle end of the cartridge, which domed portion is stiffened by integral stiffening ribs so that it is effectively rigid.

In one method of packaging, the cartridge is charged with the sealant composition, which may have a viscosity ranging from a runny liquid to a thick paste, at a convenient temperature for example in the range 15° to 40° C. The plunger is then inserted into the tube and pressed into contact with the composition, expelling all air from between the plunger and the composition, and the cartridge stored ready for use.

Whilst the commonly used cartridges are satisfactory in many respects, it happens from time to time that sealant composition extruded from a cartridge emerges in an unacceptable fashion due to unexpected emission of gas or prematurely hardened sealant composition from the cartridge during extrusion of a bead of the sealant composition. This may lead to poor quality seals and reworking and is particularly disadvantageous if the sealant composition is of the curable type. One cause of such unwanted emissions is the presence in the cartridge of air trapped as a bubble close to the plunger and which, when the composition is extruded from the cartridge, may emerge in the bead of the sealant composition as it is extruded. If a pressurised air gun is used for extrusion, this air bubble may even burst in the bead and spray the composition at random. Presence of the air bubble within the sealant composition in the cartridge can also lead to the formation of hardened portions in the sealant composition. For example, in a moisture curable sealant composition a lump of at least partially cured composition may form close to the bubble. These hardened portions may block the nozzle or otherwise disturb the extrusion of a uniform bead of the sealant composition.

It is believed that these unwanted air inclusions arise at least in part as a result of different rates of thermal expansion and contraction of the sealant composition and of the cartridge. When sealant compositions are packaged warm into cartridges, the filled volume may shrink relative to the volume of the cartridge at room temperature. A perfectly working plunger would follow this volume contraction and would also follow volume contractions and expansions induced by typical climatic temperature changes. Plungers commonly employed do not always operate in this way and specifically do not always follow the volume contractions sufficiently well to prevent air from being sucked past the periphery of the plunger and becoming trapped within the cartridge during cooling. The reasons why these plungers do not always work satisfactorily are principally due to deficient sealing between the plunger and the cartridge tube due for example to dimensional variations of the combination of cartridge and plunger, to inappropriate choice of materials for the tube or plunger, or to insufficiently smooth surface finish of the tube or plunger.

We have now found that the quality of sealant bead extruded from a cartridge can be improved if the cartridge is provided with means for constantly urging the pressure portion into engagement with the composition in the cartridge during storage thereof.

The invention provides in one of its aspects a cartridge containing a sealant composition and comprising a self supporting tube, a sealed exit port at one end of the tube, a plunger within the tube which at least substantially seals the tube against discharge of the composition between the tube and the plunger, the plunger being adapted to slide within the tube to accommodate changes in volume or distribution of the composition in the tube during storage or use and the plunger comprising a skirt portion adapted to engage the interior surface of the tube and a pressure portion adapted to transmit a force to the composition and the cartridge being intended for loading into an extrusion device having means for exerting a force to urge the plunger in the tube towards the exit port whereby to cause the composition to be dispensed through the exit port when the exit port is unsealed, and means for constantly urging the pressure portion into pressing engagement with the composition during storage of the cartridge.

In a cartridge according to the invention, the means for constantly urging the pressure portion into pressing engagement with the composition during storage may be provided by a variety of mechanisms. Suitably the means exerts a minimum pressure of 0.1 bar, preferably however closer to almost 1.0 bar, over the normally expected movement range of the plunger in the tube during storage. In one convenient form of construction, a resilient element under compression is provided between the plunger and an abutment on the open end of the tube. The resilient element may be provided by a spring of metal or plastics material or may be elastomeric or pneumatic, for example, a gas filled small ball, cushion, balloon or similar. The abutment may be provided, for example, by an end cap secured to the tube or by a lip or flange formed on the tube. In another convenient construction a resilient bellows is provided between the skirt and the pressure portion of the plunger and axial movement of the skirt outwardly of the tube is prevented by an abutment as aforesaid or by frictional forces between the skirt portion and the tube.

In another, preferred, arrangement the cartridge is enveloped in an air impervious foil and the envelope at least partially evacuated and heat sealed, the arrangement of the foil being such that in its sealed condition it conforms precisely to the shape of the cartridge and in particular bears directly or indirectly on the pressure portion of the plunger and is able to be pressed thereagainst by ambiant air. Foils suitable for use in this embodiment are those which may be heat sealed and include those conventionally employed in the heat seal-vacuum packaging art, and may be for example transparent or opaque. Transparent foils may be, for example, from 90 to 300 microns, preferably 90 to 200 microns thick and may comprise, for example, a layer of polyamide about 35 micrometres thick, a layer of polyethylene about 25 microns thick and a second layer of polyethylene about 40 microns thick. Opaque foils may be, for example, 50 to 200 microns thick, preferably about 50 to 70 microns thick and may comprise, for example, a layer of aluminium about 12 microns thick between two layers each about 25 microns thick formed from layers of polyolefin for heat sealing, stretched polypropylene and polyolefin for heat sealing. Typically, such foils offer adequate strength and heat sealing characteristics. Foils which include an aluminium layer are also impervious to air and therefore offer additional protection against ingress of air to the sealant composition. Various methods are available for enveloping the cartridge in the foil. For example one may make a bag from the foil, insert the cartridge in the bag, apply vacuum to pull the bag to the shape of the cartridge and then heat seal it. For such an operation the thinner foils may be used. Alternatively, a foil may be moulded to a curved shape complementary to the cartridge, the cartridge inserted into the curved shape and another foil placed to mate with the first foil. Application of vacuum followed by heat sealing serves to seal the package as desired. For operations where the foil will be stretched during shaping, the thicker foils are preferred. It is important to ensure that the foil is arranged to transmit pressure of the atmosphere directly or indirectly to the rigid pressure portion of the plunger during thermal contraction and expansion of the cartridge and sealant during storage (i.e. after filling the sealant into the cartridge and before dispensing the sealant from the nozzle) and the location of the seal for the foil is selected accordingly. More than one cartridge can be sealed this way into one foil enclosure under vacuum.

The principal advantage of cartridges according to the invention, namely reduction of the amount of air sucked into the cartridge past the periphery of the plunger during thermally induced volume changes during storage, is especially noticeable in relation to the preferred cartridges. These are sufficiently effective that the composition may be filled into the cartridge at a comparatively high temperature of the order of 50° C. or 60° C., the plunger inserted in the cartridge and the foil envelope applied, and heat sealed without significant sucking of air into the cartridge. This advantage is particularly valuable in respect of sealant compositions which are slow to cool in the mass after preparation and which show substantial volume change on cooling e.g. silicone based sealant compositions.

There now follows a detailed description to be read with the accompanying drawings of five cartridges according to the invention and illustrative thereof.

In the drawings FIGS. 1, 2, 3, 4 and 5 are sectional views of first, second, third, fourth and fifth illustrative cartridges respectively.

Each of the illustrative cartridges comprises a self supporting tube 10 of polyethylene. At one end the tube is formed with an integral end cap 12 and an integral nose 14 which is externally screw threaded and fitted with a preformed nozzle 16. The end cap and nose serve to provide an impervious seal arrangement at the nozzle end of the cartridge which may be broken by removing the nozzle and cutting a portion from the nose to provide an exit port or outlet (not shown). The nozzle may also be cut to provide an outlet of desired size and then screwed back onto the nose. Each cartridge also contains a plunger 18 having a skirt portion 20 provided with ribs 22 which engage the inner surface of the tube and a pressure portion 24. Sealant composition 26 which is curable upon exposure to moisture of the atmosphere completely occupies the chamber bounded by the tube, end cap and pressure portion. The pressure portion is reinforced with ribs 28 and is substantially rigid so that when the plunger is pushed towards the end cap 12, it transmits a force to the sealant composition to urge it from the cartridge via the outlets provided in the nose and nozzle. The skirt 20 is adapted to slide with its ribs in engagement with the interior of the tube 10 in response to changes in volume or distribution of the sealant composition and movement of the pressure portion 24 brought about for example during storage by pressure exerted by the sealant composition or during extrusion by pressure exerted by an extrusion gun, and the ribs 22 ensure an adequately tight fit of the skirt within the tube to at least substantially prevent flow of the sealant composition between the skirt and the tube. Each cartridge also comprises means for constantly urging the pressure portion into pressing engagement with the sealant composition during storage.

Figure 5:
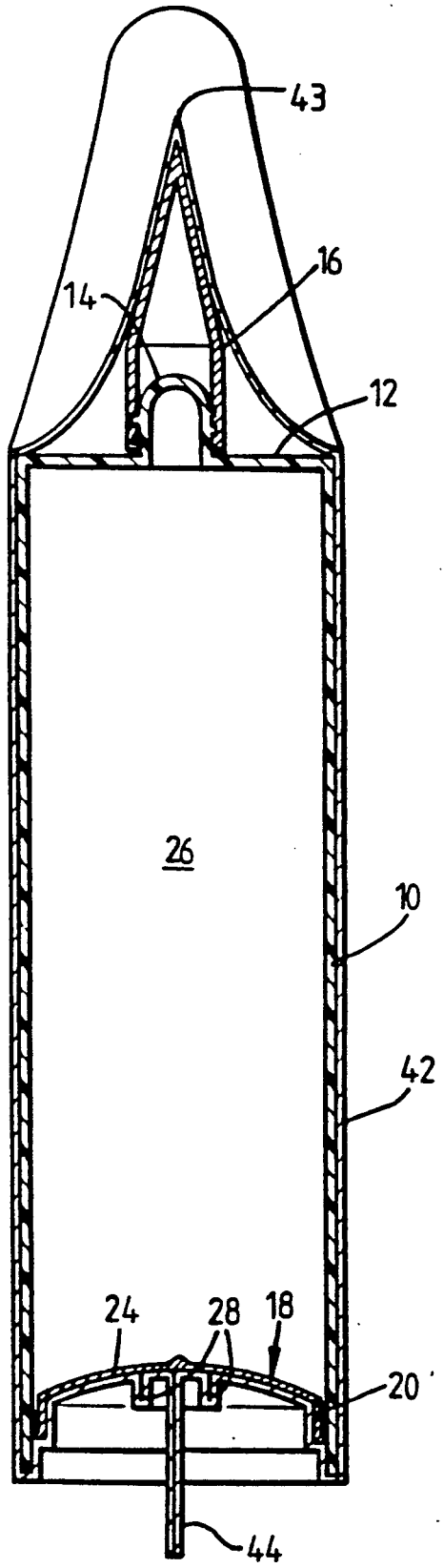

In the first illustrative cartridge (FIG. 1), this means comprises a coil spring 30 located between a surface of the pressure portion and an abutment surface of a flanged annular cap 32 screw threaded onto the open end of the tube 10. In the second illustrative cartridge (FIG. 2) this means comprises a curved spring 34 located in apertures 36 in the tube 10 and arranged to bear upon the surface of the pressure portion 24. In the third illustrative cartridge (FIG. 3) this means comprises a compressed plug of sponge rubber 38 located between the surface of the pressure portion and a surface of a cap 40 secured to the tube 10. In the fourth illustrative cartridge (FIG. 4) this means comprises a bellows 41 integral with and disposed between the pressure portion 24 and the skirt 20 and arranged to urge the pressure portion upwardly as viewed in FIG. 4. In the fifth illustrative cartridge (FIG. 5) this means is provided by an air impervious foil 42 in which the cartridge is enveloped. The package is prepared by taking a sheet of laminate comprising an aluminium layer 12 micrometers thick and two heat sealable polyolefine-stretched propylene-heat sealable olefin layers each layer of this laminate being about 25 microns thick conventionally used for heat seal vacuum packaging from a roll. The sheet is formed into a tubular shape and heat sealed to provide a longitudinal seam (not shown). A first transverse heat seal 43 is formed at one end of the tubular shape to form a bag. The cartridge is placed, nozzle foremost, into the bag. The bag is drawn to conform precisely to the shape of the cartridge and to bear directly on the pressure portion of the plunger by a vacuum packaging technique and then heat sealed. The disposition of the foil in engagement with the pressure member is facilitated by locating one open end of the foil bag at the plunger end of the tube and forming the heat seal in the region 44 spaced from the pressure member as shown in FIG. 5.

In one method of filling the cartridges, the cartridge is charged with sealant composition, which may have a viscosity ranging from a runny liquid to a thick paste and is preferably a composition curable to an elastomeric state upon exposure to the atmosphere and may be, for example, a moisture curable silicone sealant composition, at a temperature in the range 15° to 50° C. The plunger is then inserted into the tube and pressed into contact with the composition. In filling the first, second and third illustrative cartridges, the resilient element provided by the spring 30, spring 34 or plug 38 is inserted in contact with the exposed surface of the pressure portion 24 and the cap 32 or 40 secured to the tube, or the ends of the spring 34 located in the apertures 36.

When it is desired to extrude sealant composition from one of the illustrative cartridges its noze and nozzle may be cut to provide outlets for the composition as aforesaid and the cartridge may be loaded into an extrusion gun provided with means for applying a force to the plunger in the cartridge. Prior to insertion in the gun, the resilient means may be removed from the cartridge. Thus, the cap 32 and spring 30 are removed from the first illustrative cartridge, the spring 34 is removed from the second illustrative cartridge, the cap 40 and plug 38 are removed from the third illustrative cartridge, and at least the portions of the bag 42 adjacent the nozzle and the plunger of the fifth illustrative cartridge are removed. The sealant composition may then be extruded in conventional fashion.

That which is claimed is:

1. A dispensing cartridge comprising a self-supporting tube having an interior surface; an end cap having a sealed exit port closing one end of the tube; a body of sealant composition within the tube; a plunger positioned within the tube in slidable relationship therewith; the plunger having a pressure portion confining the body of sealant composition in the volume defined by the plunger, tube and end cap, and a skirt portion engaging the interior surface of the self-supporting tube; means for constantly urging the plunger toward the end cap and into pressing engagement with the body of sealant composition in order to retain the body of sealant composition under pressure until its removal from the tube through the exit port, said means for constantly urging the plunger toward the end cap and into pressing engagement with the body of sealant composition being a removable resilient bellows provided between the skirt portion and the pressure portion of the plunger.

2. The dispensing cartridge of claim 1 in which the skirt portion of the plunger includes ribs which engage the interior surface of the self-supporting tube.

3. The dispensing cartridge of claim 1 in which the pressure portion of the plunger includes ribs which reinforce the plunger.

* * * * *